United States Patent [19]

Jacobson

[11] 4,442,598

[45] * Apr. 17, 1984

[54] RAZOR BLADE ASSEMBLY

[75] Inventor: Chester F. Jacobson, Southboro, Mass.

[73] Assignee: The Gillette Company, Boston, Mass.

[ * ] Notice: The portion of the term of this patent subsequent to Jun. 2, 1998 has been disclaimed.

[21] Appl. No.: 353,856

[22] Filed: Mar. 1, 1982

Related U.S. Application Data

[63] Continuation-in-part of Ser. No. 229,976, Jan. 30, 1981, Pat. No. 4,378,634, which is a continuation-in-part of Ser. No. 101,101, Dec. 7, 1979, Pat. No. 4,270,268.

[51] Int. Cl.[3] ..... B26B 21/06; B26B 21/22

[52] U.S. Cl. ..... 30/47; 30/50; 30/77

[58] Field of Search ..... 30/47, 50, 77, 83

[56] References Cited

U.S. PATENT DOCUMENTS

| | | | |
|---|---|---|---|
| 4,146,958 | 4/1979 | Chen et al. | 30/47 |
| 4,168,571 | 7/1979 | Francis | 30/47 |
| 4,270,268 | 6/1981 | Jacobson | 30/47 |
| 4,378,634 | 4/1983 | Jacobson | 30/47 |

*Primary Examiner*—James G. Smith

*Attorney, Agent, or Firm*—Scott R. Foster

[57] ABSTRACT

A razor blade assembly including a body member, a guard member fixed to the body member, a blade member mounted on the body member for movement thereon, the blade member being independently movable in response to forces encountered during a shaving operation, spring finger biasing members integral with the body member and exercising a bias against the blade member, and a cap portion fixed to the body member.

8 Claims, 5 Drawing Figures

RAZOR BLADE ASSEMBLY

CROSS-REFERENCE TO RELATED APPLICATION

This is a continuation-in-part of application Ser. No. 229,976, filed Jan. 30, 1981, in the name of Chester F. Jacobson, now U.S. Pat. No. 4,378,634, which in turn is a continuation-in-part of application Ser. No. 101,101, filed Dec. 7, 1979, in the name of Chester F. Jacobson, now U.S. Pat. No. 4,270,268.

BACKGROUND OF THE INVENTION

1. Field of the Invention

The invention relates to wet shaving implements and is directed more particularly to a razor blade assembly including cap, blade and guard elements connected together and replaceable as a unit on a cooperative razor handle.

2. Description of the Prior Art

It is generally known in the art to provide a razor blade assembly, which may be connected to, and used in conjunction with, a razor handle to facilitate shaving operations. U.S. Pat. No. 3,660,893, issued May 9, 1972, shows a blade assembly in which blade means are held at either end thereof and disposed between blade assembly surfaces adapted to engage the surface being shaved in front of and behind, respectively, the blade means cutting edge portions. Such surfaces are generally referred to as "guard" and "cap". U.S. Pat. No. 4,084,316, issued Apr. 18, 1978, discloses a similar blade assembly, but one in which the blade means are supported by thin strips of metal. In U.S. Pat. No. 4,168,571, issued Sept. 25, 1979, there is disclosed a blade assembly whose blade means are attached to thin metal strips which in turn are mounted for movement in the blade assembly to permit dynamic movement of the blade means during a shaving operation. In addition, the guard and cap means are mounted for similar movement.

SUMMARY OF THE INVENTION

An object of the present invention is to provide a blade assembly, generally similar to the blade assembly disclosed in U.S. Pat. No. 4,168,571, but improved thereover.

With the above and other objects in view, as will hereinafter appear, a feature of the present invention is the provision of a razor blade assembly comprising a body member, a guard member fixed to the body member, blade means mounted on the body member for movement thereon, the blade means being movable in response to forces encountered during a shaving operation, and spring finger biasing means integral with the body member and exercising a bias against the blade means.

The above and other features of the invention, including various novel details of construction and combinations of parts, will now be more particularly described with reference to the accompanying drawings and pointed out in the claims. It will be understood that the particular blade assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 2:
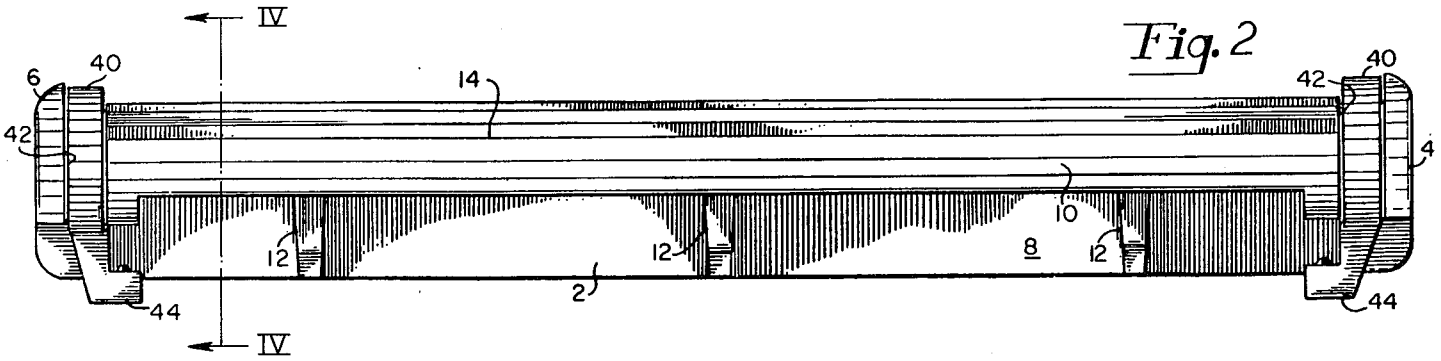
FIG. 2 is a back elevational view thereof.

Referring to the drawings, it will be seen that the illustrated razor blade assembly includes a body member 2, which may be of molded plastic, having first and second end portions 4, 6 interconnected by front and back wall portions 8, 10. Frame portions 12 (FIGS. 2 and 3) extend width-wise of the body member, interconnecting the front and back walls 8, 10.

The back wall portion 10 of the body member 2 has an upper portion 14 which engages skin being shaved behind the cutting means of the assembly, thereby fulfilling the functions and occupying the position of the "cap" portion of conventional razor blade assemblies. Such portion 14 shall, for that reason, be referred to hereinafter as the "cap portion".

Figure 1:
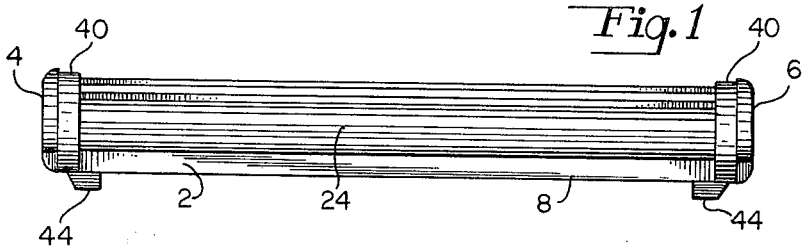
FIG. 1 is a front elevational view of one form of blade assembly illustrative of an embodiment of the invention.
Figure 4:
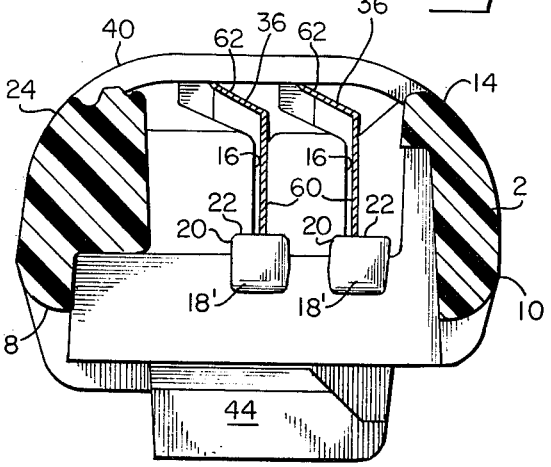
FIG. 4 is a sectional view taken along line IV—IV of FIG. 2.
Figure 3:
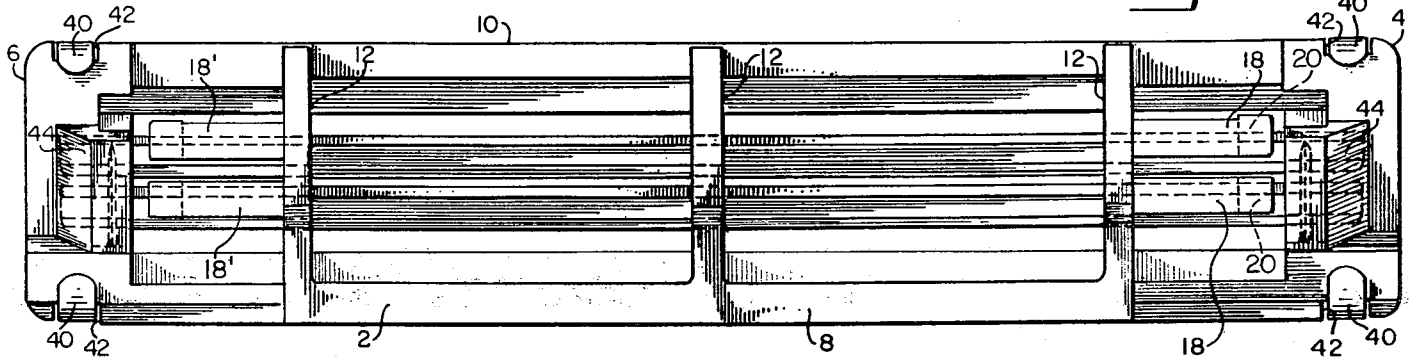
FIG. 3 is a bottom plan view thereof.

Each of the end portions 4, 6 is provided with opposed slots 16 (FIG. 4). One of the frame members 12 near the first end portion 4 is provided with spring fingers 18 extending therefrom, and preferably molded integrally therewith, generally parallel to the front and back walls 8, 10 (FIG. 3). Each of the fingers 18 is provided with an upturned end portion 20 having an upper surface 22. In like manner, another of the frame members 12 near the second end portion 6 is provided with spring fingers 18' of similar configuration and structure (FIG. 3), with upturned end portions 20' having upper surfaces 22'. The fingers 18, 18' extend in opposite directions, the fingers 18 extending toward the first end portion 4 of the body member 2 and the fingers 18' extending toward the second end portion 6 of the body member. The fingers 18 and the fingers 18' are aligned with each other and with the slots 16.

The assembly includes a guard portion 24, which is an extension of the front wall portion 8, and which, in a shaving operation, travels over the surface being shaved ahead of the cutting means.

The assembly further includes blade means comprising first and second blades 36, 36' (FIG. 4) each comprising a shaped member having a base portion 60 resting upon a pair of the spring fingers 18, 18' and a cutter portion 62, the two portions 60, 62 defining therebetween an outside angle. In use, the blades 36, 36' are individually movable in the planes of the base portions 60, respectively, and are able to move in response to pressure applied thereto further into the slots 16, and to move upwardly in the slots 16 in response to the bias of the spring fingers.

The first and second blades 36, 36' are clamped in place by spring clamps 40, which are received in slots 42 in the end portions 4, 6. The clamps 40 engage the blades 36, 36', forcing them into the slots 16 to a point where a slight stress is placed on the spring fingers 18, 18'.

Figure 5:
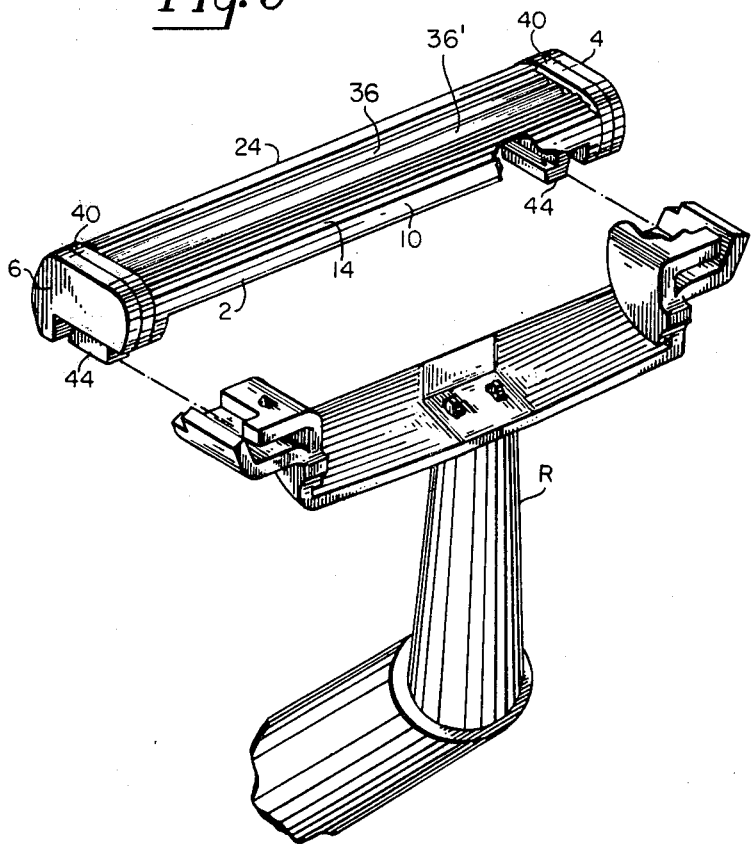
FIG. 5 is a perspective view thereof; shown with a razor handle adapted to be used in conjunction with the blade assembly.

The assembly is provided, on its underside, with connecting means 44 by which the blade assembly may be connected to a cooperating razor handle R, as illustrated in FIG. 5.

In use, the blade assembly is connected to the handle R and used for shaving operations, during which the blade means 36, 36', are individually movable in the directions in which extend the slots 16. Thus, the blade components of the blade assembly may adjust dynamically to the surfaces being shaved.

It is to be understood that the present invention is by no means limited to the particular construction herein disclosed and/or shown in the drawings, but also comprises any modification or equivalents within the scope of the disclosure.

Having thus described my invention, what I claim as new and desire to secure by Letters Patent of the United States is:

1. A razor blade assembly comprising a body member, a guard member fixed to said body member, blade means mounted on said body member for movement thereon, said blade means being independently movable in response to forces encountered during a shaving operation, and spring finger biasing means integral with said body portion and exercising a bias against said blade means, said blade means comprising a shaped member having a base portion and a cutter portion, said base and cutter portions defining therebetween an obtuse angle.

2. The invention in accordance with claim 1 in which said blade means comprises first and second blade members, said first and second blade members being movable independently of each other, against said bias.

3. The invention in accordance with claim 2 in which said base portions of said first and second blade members are mounted respectively on said spring finger biasing means.

4. The invention in accordance with claim 3 in which said spring finger biasing means comprises first spring finger means in engagement with said first blade base portion, and second spring finger means in engagement with said second blade base portion.

5. The invention in accordance with claim 4 in which each of said spring finger means comprises a pair of spring fingers.

6. The invention in accordance with claim 5 in which said body portion is of molded plastic and said spring fingers are molded integrally with said body portion.

7. The invention in accordance with claim 2 in which said spring fingers biasing means includes a first set of spring fingers biasing said first blade member, and a second set of spring fingers biasing said second blade member.

8. The invention in accordance with claim 7 in which said body member is of molded plastic and said first and second sets of spring fingers are molded integrally with said body member.

* * * * *